US005992528A

United States Patent [19]

Parkinson et al.

[11] Patent Number: 5,992,528

[45] **Date of Patent: *Nov. 30, 1999**

[54] INFLATOR BASED FIRE SUPPRESSION SYSTEM

[75] Inventors: David W. Parkinson, North Ogden; Bradley W. Smith, Ogden; Robert E. Lewis, Roy, all of Utah

[73] Assignee: Autoliv ASP, Inc., Ogden, Utah

[ * ] Notice: This patent issued on a continued prosecution application filed under 37 CFR 1.53(d), and is subject to the twenty year patent term provisions of 35 U.S.C. 154(a)(2).

[21] Appl. No.: 08/842,809

[22] Filed: Apr. 17, 1997

[51] Int. Cl.[6] ..... A62C 35/02; A62C 3/07

[52] U.S. Cl. ..... 169/6; 169/26; 169/61; 169/62; 169/77; 169/84

[58] Field of Search ..... 169/6, 7, 9, 12, 169/26, 27, 28, 58, 61, 62, 77, 84, 89

[56] References Cited

U.S. PATENT DOCUMENTS

| | | | |
|---|---|---|---|
| 2,719,589 | 10/1955 | Mapes | 169/28 X |
| 3,010,520 | 11/1961 | Seaberg | 169/77 |
| 3,762,479 | 10/1973 | Fike, Sr. et al. | 169/28 |
| 3,788,666 | 1/1974 | Kramer et al. | 280/739 |
| 3,961,669 | 6/1976 | Kaneko | 169/62 |
| 3,965,988 | 6/1976 | Wesson et al. | 169/77 X |
| 4,046,156 | 9/1977 | Cook | 169/28 X |
| 4,319,640 | 3/1982 | Brobeil | 169/28 |

FOREIGN PATENT DOCUMENTS

| | | | |
|---|---|---|---|
| 910346 | 6/1946 | France | 169/28 |

*Primary Examiner*—Andrew C. Pike
*Attorney, Agent, or Firm*—Ohlandt, Greeley, Ruggiero & Perle, L.L.P.; George W. Rauchfuss, Jr.

[57] ABSTRACT

A fire extinguisher comprises a pressure bottle containing the fire extinguishing material and having mounted therein a diffuser-actuation housing. A source of pressurized gas is in at least one of the pressure bottle or the housing or may be in both. The housing has internal exhaust ports for permitting flow of the fire extinguishing material from the interior of the pressure bottle to the interior of the housing and external diffuser ports for delivering the fire extinguishing material from the interior of the housing to the area of a fire. Intermediate the internal exhaust ports and the external diffuser ports there is positioned a burst element, for interrupting the flow path between the internal exhaust ports and the external diffuser ports until the burst element is ruptured. Mounted within the housing, on a side of the frangible burst element opposite the exhaust ports, is an initiator or electro-explosive device and a rupture element, such as a projectile or gas-producing pyrotechnic material or a combination of both, for rupturing the frangible burst element and opening the flow path upon actuation of the initiator. The exhaust ports preferably have pick-up tubes extending into powdered fire suppression material in the pressurized bottle.

7 Claims, 3 Drawing Sheets

INFLATOR BASED FIRE SUPPRESSION SYSTEM

FIELD OF THE INVENTION

This invention relates to a system and apparatus for suppression or extinguishment of a fire using an automotive airbag type inflator for dispensing and dispersing fire suppression material from a pressure vessel. More particularly, this invention relates to a system and apparatus for suppression or extinguishment of a fire using an automotive pyrotechnic or hybrid type airbag inflator for dispensing and dispersing powdered fire suppression material from a pressure vessel.

BACKGROUND OF THE INVENTION

Basically there are two methods of fire-fighting. The first method involves maintaining a temperature in the area of the fire which is below the combustion temperature of those areas surrounding the burning areas. The second method is directed to stopping combustion or burning once it has begun by some means of smothering the fire, usually by depleting the oxygen supply. This latter method generally involves dispersing a fire extinguishing material onto the fire to separate it from the oxygen supply.

Fires can occur in a wide variety of environments and the ability to effectively extinguish such fires can vary from relatively simple to complex. One area of particular concern is the occurrence of fires in motor vehicles where the danger posed by ruptured fuel lines or the like can result in extremely dangerous situations occurring if the fire or source of flame is not rapidly extinguished. Similarly, where fires can occur in undetected locations, for example, in unmanned telephone switch rooms or the like, it is essential that a rapid means of extinguishing a fire be available.

While a number of systems have been proposed for delivering a fire extinguishing material to the area of a fire for extinguishing or suppressing the fire, a wide variety of drawbacks have limited their effectiveness and usefulness for fire-fighting.

SUMMARY OF THE INVENTION

It is therefore an object of this invention to provide a system and apparatus for suppression or extinguishment of a fire by a reliable, effective fire extinguishing device that can be effectively employed in a wide variety of locations and environments and is capable of dispersing a fire extinguishing material onto a fire. A further object of this invention is to provide such a fire extinguishing device that can be relatively small in size and thus can be placed in a wide variety of locations. A further object of this invention is to provide such a fire extinguishing device that rapidly and effectively disperses a fire extinguishing powder from a pressure bottle by means of pressurized gas.

In accordance with this invention, there is provided a fire extinguisher for dispersing a fire extinguishing material from a pressure bottle, such as a vehicle airbag inflator, under the influence of a pressurized gas, either stored compressed gas or a pressurized gas generated upon actuation of the fire extinguishing device or a combination of said two sources of pressurized gas.

In accordance with this invention, there is provided a fire extinguisher which comprises a pressure bottle containing the fire extinguishing material and having mounted therein a diffuser-actuation housing. A source of pressurized gas is in at least one of the pressure bottle or the housing or may be in both. The housing has internal exhaust ports for permitting flow of the fire extinguishing material from the interior of the pressure bottle to the interior of the housing and external diffuser ports for delivering the fire extinguishing material from the interior of the housing to the area of the fire. Intermediate the internal exhaust ports and the external diffuser ports there is positioned a frangible burst means, such as a burst disk, for interrupting the felow path between the internal exhaust ports and the external diffuser ports until the burst means is ruptured. Mounted within the housing, on a side of the frangible burst means opposite the exhaust ports, is an initiator or electro-explosive device and rupture means, such as a projectile or gas-producing pyrotechnic material or a combination of both, for rupturing the frangible burst means and opening the flow path upon actuation of the initiator. The exhaust ports preferably have pick-up tubes extending in to the fire suppression material in the pressurized bottle.

In a preferred form of this invention, the fire extinguisher comprises a pressure bottle having an opening at one end with a tubular diffuser-actuation housing mounted in the opening. The tubular diffuser-actuation housing h as a first portion projecting axially into the pressure bottle and an opposite, second tubular portion projecting axially outwardly from the pressure bottle. The housing generally defines a tubular sidewall terminating in an endcap in the pressure bottle and a mouth outwardly of said pressure bottle, with an initiator being mounted in said mouth. Outwardly of the pressure bottle the tubular sidewall has a plurality of radial diffuser ports circumferentially spaced around the tubular sidewall. The endcap has a plurality of exhaust ports therethrough for defining access from the interior of the pressure bottle to the interior of the tubular housing. A frangible burst disk is mounted in the tubular housing intermediate the exhaust ports and the diffuser ports so that the burst disk interrupts the flow path between these ports until the burst disk is ruptured. Between the initiator and the burst disk there is located means to rupture the burst disk upon actuation of the initiator to thereby open the flow path. The means to rupture the burst disk can be, for example, a projectile or a gas-generating material or a combination of these two means. Powdered fire suppression material is housed in the pressure bottle. A source of pressurized gas is located in either the pressure bottle or the housing, or may be in both, for causing the fire suppression material to flow through the exhaust ports, along the flow path, and out the diffuser ports upon rupture of the burst disk. The source of pressurized gas may be compressed gas housed in the pressure bottle with the fire extinguishing material, gas-producing material in the tubular housing, the material being combustible to produce pressurized gas upon actuation of the initiator, or a combination of these two sources of pressurized gas. The means to rupture the burst disk can be gas pressure generated by combustible gas-producing material in the tubular housing or a projectile, preferably a projectile propelled by pressurized gas generated by gas-generating combustible material in tubular housing.

In a further aspect of this invention the pressure bottle may be provided with conduits from the diffuser ports for obtaining a desired dispersal pattern of the fire extinguishing material in the pressure bottle.

As will be appreciated from the foregoing description and the following drawings and description of several embodiments of this invention, the fire extinguishers of this invention can take a wide variety of forms tailored for various applications without departing from the spirit and scope of the invention.

DETAILED DESCRIPTION OF THE INVENTION

Figure 1:
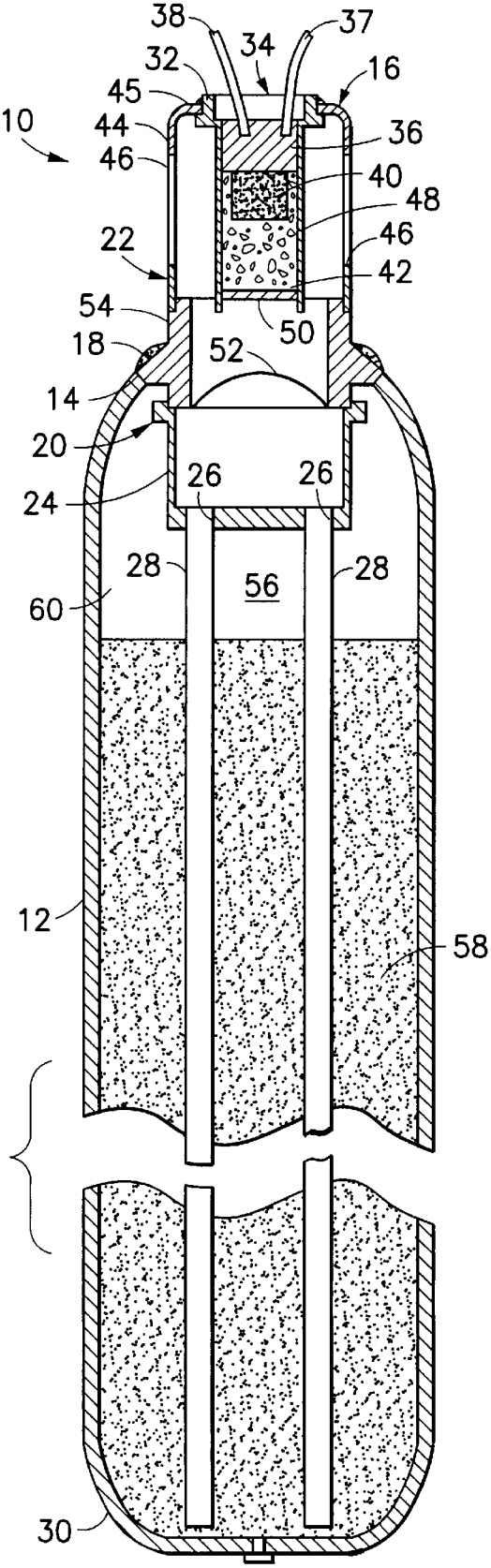
FIG. 1 is a cross-sectional view of a first embodiment of a fire extinguisher of this invention.

A fire extinguisher 10 of this invention, in which fire extinguishing material is dispersable from the extinguisher by the action of stored compressed gas, is disclosed in FIG. 1. Fire extinguisher 10 comprises a pressure bottle 12 having an opening 14 at one end thereof. Mounted in opening 14 is a tubular diffuser-actuation housing 16 and secured therein by any suitable means, such as by a weld 18.

A first portion 20 of housing 16 extends axially inwardly into the pressure bottle 12 and a second portion 22 extends axially outwardly from the pressure bottle. The first portion 20 terminates inside bottle 12 in an endwall or endcap 24 having at least one, but generally a plurality, exhaust port 26 which may include pick-up tubes 28 extending into the interior of the pressure bottle 12 to near the end 30 of the bottle opposite opening 14.

The second portion 22 of housing 16 terminates in endwall 45 having a central mouth 32 in which is mounted an initiation or actuation assembly 34 comprising an electro-explosive initiator or squib 36, connected by means of electrical lead wires 37, 38 to a sensor or actuator (not shown), and aligned with an ignitable initiator material 40 which in turn is in alignment with a combustible gas-producing pyrotechnic charge 42. Second housing portion 22 is provided with a plurality of diffuser ports 46 spaced circumferentially around the second portion of the housing. Although the diffuser ports 46 are shown as radial ports in sidewall 44, it will be understood that these ports could be axial ports circumferentially spaced in endwall 45 around mouth 32 of said second housing portion 22. Squib 36, initiator material 40, and pyrotechnic charge 42 may be housed in an initiation chamber housing 48 located within second portion 22 of housing 16, concentrically with sidewall 44. A suitable end cover 50 for housing 48 retains the pyrotechnic material in said housing. In housing 16, intermediate exhaust ports 26 and diffuser ports 46, is a frangible burst disk 52 retained in disk housing 54 formed as part of sidewall 44. Burst disk 52 interrupts the flow path between exhaust ports 26 and diffuser ports 46 until the disk is ruptured upon actuation of activation assembly 34, as explained hereinafter. Burst disk 52 also provides a closed chamber 56 in pressure bottle 12. A quantity of fire extinguishing powder 58 is stored in chamber 56, ready to be dispersed upon activation of fire extinguisher 10. Also, in closed chamber 56 is a quantity of compressed pressurized gas 60.

Operation of fire extinguisher 10 is indicated at a desired time by sending actuation signals through lead wires 37, 38 to squib 36 to ignite initiation material 40 causing combustion of gas-producing pyrotechnic charge 42. Combustion of charge 42 produces highly pressurized gas causing rupture of burst disk 52, allowing stored compressed gas 60 to force fire extinguishing material 58 up pick-up tubes 28 of exhaust ports 26 and through housing 16 to and out diffuser ports 46 for dispersal onto or into an area of a fire. The actuation signals for starting the process can be triggered by any suitable means, such as a mechanical, electrical, or manual sensor or actuator. For example, the actuation signals can be caused to occur by a collision sensor, by automatically or manually mechanically closing a circuit, or any other suitable means for automatic actuation upon sensing of a certain situation occurring or about to occur.

In a variant of the embodiment described in FIG. 1, the burst disk could be ruptured in a projectile, preferably a pointed projectile, appropriately placed in the initiation chamber between the gas-producing, pyrotechnic material and the burst disk.

Figure 2:
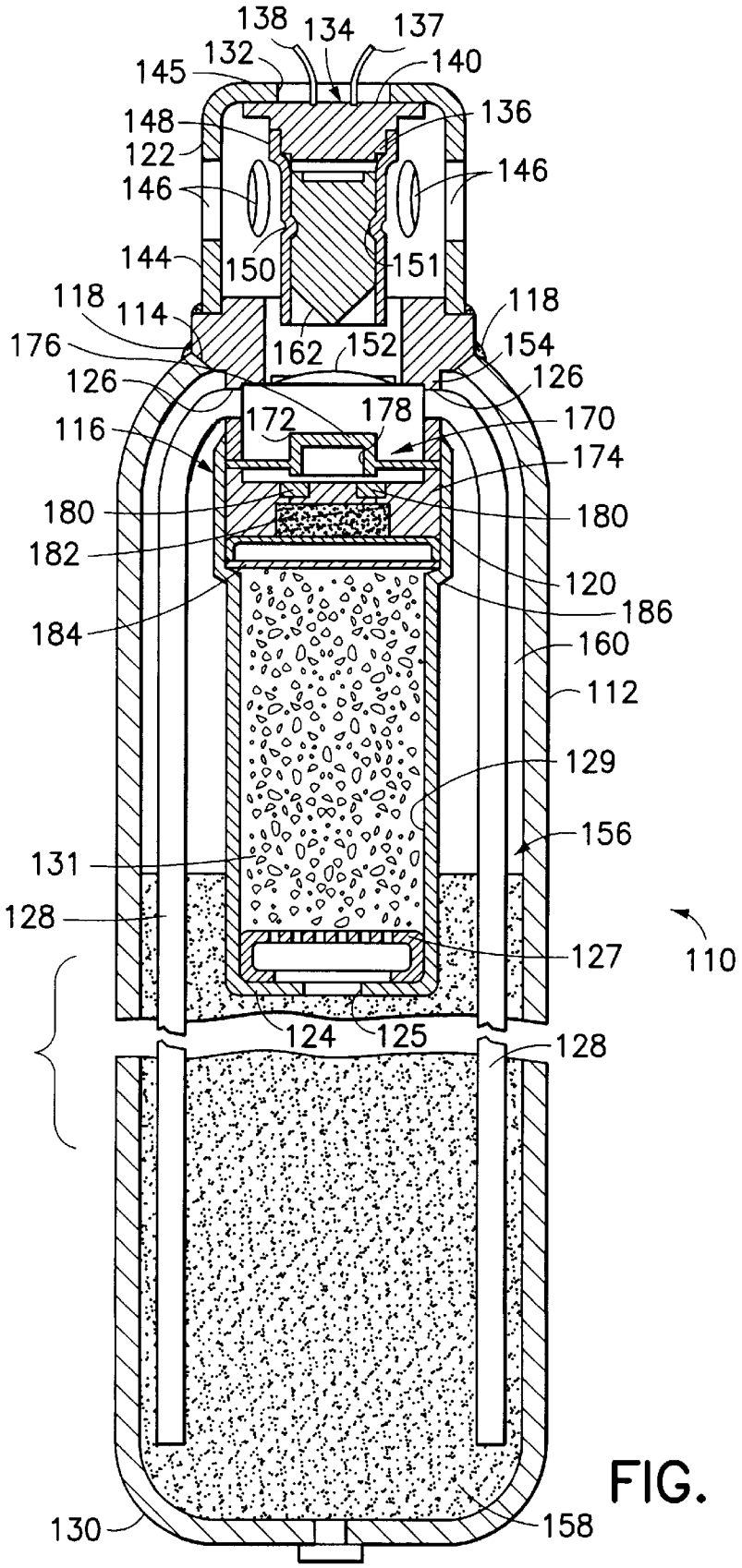
FIG. 2 is a cross-sectional view of further embodiments of a fire extinguisher of this invention.

A further embodiment of fire extinguishers of this invention is illustrated in FIG. 2. Fire extinguisher 110 comprises a pressure bottle 112 having an opening 114 at one end thereof. Mounted in opening 114 is a tubular diffuser-actuation housing 116 and secured therein by any suitable means, such as by weld 118.

A first portion 120 of housing 116 extends axially inwardly into pressure bottle 112 and a second portion 122 extends axially outwardly from the pressure bottle. The first portion 120 terminates inside the bottle in an endwall 124 facing the end of bottle 112 opposite housing 116 and having at least one gas generant opening 125. Adjacent end wall 124 and generant opening 125 is a filter retainer element 127 for retaining adjacent gas-producing combustible material 131 housed in a combustion chamber 129 defined by first portion 120 of housing 116.

The second portion 122 of housing 116 terminates in an endwall 145 having a central mouth 132 in which is mounted an initiation or actuation assembly 134 comprising an electro-explosive initiator or squib 136, connected by means of lead wires 137, 138 to a sensor or actuator (not shown) and aligned with an ignitable initiator material 140.

Second housing portion 122 is also provided with a plurality of radial diffuser ports 146 spaced circumferentially around the second portion of the housing in sidewall 144. Squib 136 and initiator material 140 are housed in a tubular initiation chamber housing 148 located in second portion 122 of housing 116, concentrically with sidewall 144. Initiation chamber housing 148 mounts a generally pointed projectile 162 adjacent initiator material 140 and facing inwardly toward the first portion 120 of housing 116. Projectile 162 is aligned with a burst disk 152 mounted in a burst disk housing section 154 of first housing portion 120. The housing 148 serves as guide to direct the projectile toward the burst disk 152 and concentrate a substantial portion of the actuation force from the squib 136 and ignitor material 140 to the projectile 162.

Adjacent burst disk 152, on a side of the burst disk opposite projectile 162, sidewall 144 of first housing portion 120 is provided with a plurality of exhaust ports 126. Each of the exhaust ports 126 can include a pick-up tube 128 extending to near the end 130 of the bottle 112 opposite opening 114. Burst disk 152 thus interrupts the flow path between exhaust ports 126 and diffuser ports 146 until the disk is ruptured by projectile 162 upon actuation of initiator assembly 134. Burst disk 152 also provides a closed chamber 156 in pressure bottle 112. A quantity of fire extinguishing material 158 is stored in chamber 156, ready to be dispersed upon actuation of fire extinguisher 110. Also in chamber 156 is a quantity of pressurized gas 160, which can be optionally present.

When an appropriate actuation signal is received by the pressure bottle 112 from an actuator or sensor (not shown)

through lead wires 137, 138 to squib 136 or other suitable electro-explosive device and ignitor material 140 is ignited, projectile 162 is propelled through the burst disk 152 to provide a flow path from chamber 156 for the stored powdered fire extinguishing material 158.

In first housing portion 120 intermediate and adjacent combustion chamber 129 and burst disk 152 is a combustion ignition assembly 170. The combustion ignition assembly 170 includes an actuation plate 172 aligned with projectile 162. The plate 172 is held between disk housing 154 and charge holder 174 and is able to deflect toward the charge holder when, and only when, impacted by projectile 162. Actuation plate 172 may have a projecting or convexly shaped portion 176 facing projectile 162 in order to reduce the distance the projectile has to travel to impact the plate. Plate 172 has impacting member 178, either a continuous ring or a plurality of individual extensions, positioned therein so as to strike at least one of a plurality of percussion primers 180. Positioned proximate primers 180 is ignition charge 182. The charge holder 174, and thus primers 180 and ignition charge 182 are maintained between the disk housing 154 and the combustion chamber 129 by a retainer 184 which contacts a shoulder portion 186 of the first portion 120 housing 116.

Thus, after the projectile 162 passes through burst disk 152 it impacts actuation plate 172. Housing 148 may be sufficiently long such that the entire projectile 162 will not leave the housing 148 to impact actuation plate 172. Thus, the projectile 162 can rebound back into housing 148 after impacting plate 172 and be retained in the housing during use of the extinguisher 110. Housing 148 may have a crimp 150 in its sidewall to engage a groove 151 on the projectile 162 to assist in maintaining the projectile in position prior to activation. Upon impact of projectile 162 on actuation plate 172, the plate deflects and impacting member 178 strikes one or more of the percussion primers 180 and thereby ignites the ignition charge 182 and gas-generating combustible material 131, and gasses generated by the combustible material 131 flow through filter 127 and gas generator opening 125 greatly increasing the gas pressure in chamber 156 of bottle 112. If sufficient gas combustible material is employed in combustion chamber 129 to produce suitable high pressure in chamber 156, it may not be necessary to employ stored compressed gas 160 in chamber 156. However, it is generally preferred to employ stored compress gas 160 in chamber 156 and supplement that gas with the gas produced on combustion of gas-producing material 131.

As soon as projectile 162 bursts disk 152 stored compressed gas 160 forces fire extinguishing material 158 up pick-up tubes 128 through exhaust ports 126 and out diffuser ports 146 to be dispersed onto or into the area of a fire.

Figure 3:
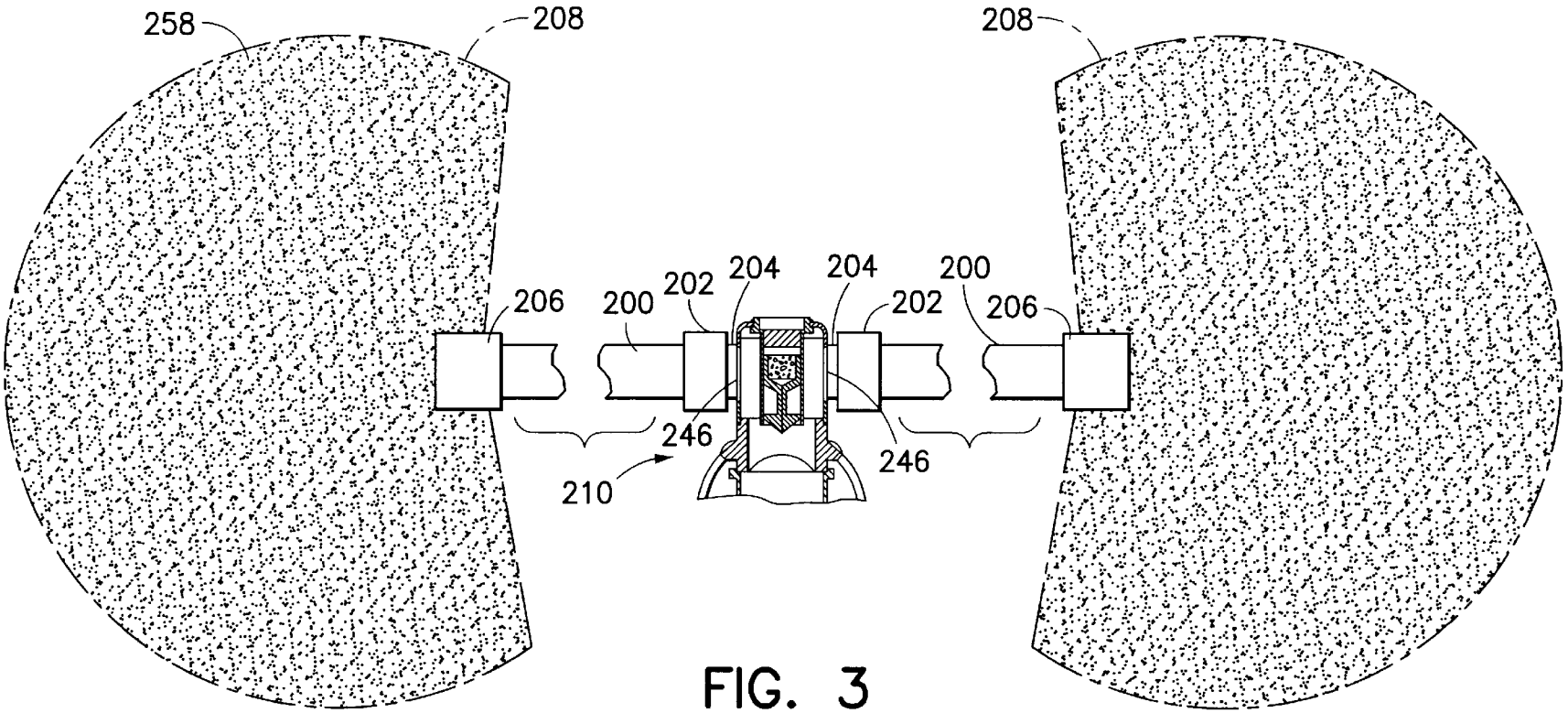
FIG. 3 is a partial cross-sectional view of a modification of this invention in which the fire extinguisher is provided with discharge tubing for providing a desired dispersal pattern for dispersal of fire extinguishing material from the extinguisher.

Another feature of the invention is illustrated in the simplified view of FIG. 3 showing a partial view of a fire extinguisher of this invention. The extinguisher 210 has discharge tubing 200 connected to the diffuser ports 246 of the extinguisher. The discharge tubing 200 is preferably flexible tubing and is connected by fitting 202 on coupling 204 attached to the diffuser port 246 such as by being welded thereto or threaded therein. At the discharge end of tubing 200 the tubing is provided with a nozzle 206 selected to give the desired or predetermined dispersal pattern 208 of fire extinguisher material 258.

It will be appreciated that the fire extinguishers of this invention can be produced in various sizes and therefore are suitable for mounting in a variety of locations. One location, for example, could be in an engine compartment of a motor vehicle where a collision or impact sensor could provide the signal for actuation of the extinguisher so as to prevent fires from ruptured fuel lines that could occur from a collision.

While only several variants of the invention have been illustrated in the figures, it will be appreciated that various fire extinguishers may be constructed in accordance with this invention by combining various features of the afore-described embodiments without departing from the spirit and scope of the invention.

With the foregoing description of the invention, those skilled in the art will appreciate that modifications may be made to the invention without departing from the spirit thereof. Therefore, it is not intended that the scope of the invention be limited to the specific embodiments illustrated and described.

We claim:

1. A fire extinguisher for suppressing a fire, said fire extinguisher comprising:

a pressure bottle defining an opening at one end thereof;

a tubular diffuser-actuation housing mounted in said opening, the tubular diffuser-actuation housing having a first tubular portion projecting axially into said pressure bottle and an opposite, second tubular portion projecting axially outwardly from said pressure bottle, said housing defining a tubular sidewall terminating in an endcap in said pressure bottle, and a mouth outwardly of said pressure bottle, said mouth having an initiator mounted therein;

the second tubular portion of the housing having a plurality of radial diffuser ports circumferentially spaced around said tubular sidewall;

the first tubular portion of the housing having a plurality of exhaust ports therethrough for defining access from interior of the pressure bottle to interior of the tubular housing;

a frangible burst disk mounted in said tubular housing intermediate the exhaust ports and the diffuser ports, said burst disk interrupting flow paths between said exhaust ports and said diffuser ports until said burst disk is ruptured;

burst disk rupture means axially intermediate the initiator and the burst disk, said rupture means being for rupturing the burst disk upon actuation of the initiator and thereby open said flow paths;

fire suppression material housed in said pressure bottle; and a source of pressurized gas within said fire extinguisher comprising a gas-producing combustible material in the tubular housing, wherein said gas-producing material is combustible to produce the pressurized gas upon actuation of the initiator for causing the fire suppression material to flow through the exhaust ports, along the flow paths, and out the diffuser ports upon rupture of the burst disk.

2. A fire extinguisher of claim 1 wherein the source of pressurized gas comprises a combination of compressed gas housed in the pressure bottle and said gas-producing combustible material in the tubular housing.

3. A fire extinguisher of claim 2 wherein each exhaust port comprises a pick-up tube extending into the fire suppression material in the pressure bottle and the fire suppression material is a powder.

4. A fire extinguisher of claim 1 wherein the burst disk rupture means comprises a projectile.

5. A fire extinguisher of claim 4 wherein each exhaust port comprises a pick-up tube extending into the fire suppression material in the pressure bottle and the fire suppression material is a powder.

6. A fire extinguisher of claim 1 wherein each exhaust port comprises a pick-up tube extending into the fire suppression material in the pressure bottle and the fire suppression material is a powder.

7. A fire extinguisher of claim 1 wherein the rupture means comprises a projectile mounted in an axially aligned initiation chamber housing in said second housing portion;

the plurality of exhaust ports in the first tubular portion are circumferentially spaced around the tubular sidewall at a location proximate the burst disk;

the fire extinguishing material comprises powdered fire extinguishing material; and the first portion further defines a combustion chamber housing the gas-producing combustible material and terminating in a housing endwall having a central mouth opening for release of the pressurized gas into the pressure bottle upon combustion of the gas-producing combustible material, and a combustion initiation assembly intermediate the combustion chamber and said burst disk, said combustion initiation assembly comprising an ignitable ignition charge, at least one percussion primer, and a deflectable activation member positioned in said first tubular portion for being struck by the projectile after the projectile ruptures the burst disk, said activation member defining impact means thereon for impacting the at least one percussion primer upon deflection of said activation member whereby said at least one percussion primer ignites the ignitable ignition charge causing the combustion of the gas-generating combustible material in the combustion chamber.

* * * * *